United States Patent [19]

Foster

[11] 4,197,190

[45] Apr. 8, 1980

[54] PROCESS FOR DEHYDRATING TAR AND/OR HYDROCARBON OILS

[75] Inventor: Anthony Foster, Bridgeville, Pa.

[73] Assignee: Koppers Company, Inc., Pittsburgh, Pa.

[21] Appl. No.: 919,223

[22] Filed: Jun. 26, 1978

[51] Int. Cl.[2] ..... C10G 33/00

[52] U.S. Cl. ..... 208/187; 196/128

[58] Field of Search ..... 208/187, 188; 196/128, 196/127

[56] References Cited

U.S. PATENT DOCUMENTS

| | | | |
|---|---|---|---|
| 1,553,973 | 9/1925 | Ballou | 208/187 |
| 1,611,370 | 12/1926 | Primrose | 208/187 |
| 1,879,849 | 9/1932 | Hunter | 208/187 |
| 2,039,981 | 5/1936 | Rembert | 196/127 |
| 2,366,901 | 1/1945 | Janeway, Jr. | 208/187 |
| 2,673,833 | 3/1954 | Radasch | 208/187 |
| 2,930,749 | 3/1960 | Davis | 208/187 |
| 3,273,629 | 9/1966 | Sargeant | 208/187 |
| 4,019,977 | 4/1977 | Hachadoorian et al. | 208/188 |
| 4,121,352 | 10/1978 | Lameris | 196/128 |

*Primary Examiner*—George Crasanakis

*Attorney, Agent, or Firm*—Donald M. MacKay; Herbert J. Zeh, Jr.; Oscar B. Brumback

[57] ABSTRACT

Tars and hydrocarbon oils containing water are dehydrated in a thermally efficient and environmentally acceptable manner. The tars or hydrocarbon oils are heated externally to any holding vessel to a temperature equivalent to at least 100° C. at atmospheric pressure and are sprayed into a holding vessel to enhance the separation of water from the tars or hydrocarbon oils. Then the water in the vapor state is removed from the holding vessel and scrubbed to remove any noxious chemicals.

7 Claims, 4 Drawing Figures

PROCESS FOR DEHYDRATING TAR AND/OR HYDROCARBON OILS

BACKGROUND OF THE INVENTION

This invention is related to a process and an apparatus for removing water from tars and/or hydrocarbon oils. More particularly, this invention is related to a process and an apparatus for dehydrating tars and/or hydrocarbon oils, such as coal tar distillates, and creosote wood preserving solutions in an energy, environmental, and operationally efficient manner.

Generally, water can be removed from tars and hydrocarbon oils by heating, distillation, evaporation, vacuum dehydration, or by chemical action. Whether one method is used rather than another depends on several factors, such as the quantity of water to be removed, the types of chemicals present in the solution from which the water is to be removed, and the difficulty of removing water from the solution.

Because of the growing concern against the deterioration of the environment, chemical plants and processing plants using chemicals must conduct their activities in such a manner as to reduce exposing noxious chemicals to the environment. Therefore, the dumping of tar and/or hydrocarbon oils or derivatives thereof into large ponds or lagoons for disposal or for removal of waste by evaporation is no longer an acceptable practice. Also, dumping of effluents or used organic processing solutions containing tar and/or hydrocarbon oils into rivers or ditches for disposal is no longer an acceptable practice. In addition, according to current economics it is more feasible to recover tars and/or hydrocarbon oils or processing solutions containing them rather than disposing of them.

Removal of water from tars, hydrocarbon oils or processing solutions containing them while recovering the tar and/or hydrocarbon oil with a reduced water content can be accomplished in an enclosed vessel in order not to adversely affect the environment with noxious fumes or other discharges. The use of an enclosed vessel in the evaporation, distillation, or dehydration of water from a tar and/or hydrocarbon oil or processing solution containing them can be troublesome if the heating mechanism is inside the enclosed vessel and the tar and/or hydrocarbon oil or processing solution containing them has a tendency to form solids or semisolid material, i.e., cokes or coagulates, when subjected to heat. With these types of tars and/or hydrocarbon oils or processing solutions containing them, the thermal efficiency of the heating mechanisms in the enclosed vessels is reduced by deposition of the solid or semisolid material on the surfaces of the heating mechanisms. The heating mehanisms cannot be readily removed for cleaning from the enclosed vessel containing the tar or hydrocarbon oil. A resulting loss of efficiency from shutting down the process to remove the heating mechanisms would be difficult to overcome or reverse.

An example of such a troublesome situation exists for the material derived from coal tar and known as creosote. Creosote consists principally of liquid and solid aromatic hydrocarbons. A more precise definition of creosote is that it consists of the 200°–400° C. boiling fraction oof coal tar distillate produced by the high temperature carbonization of bituminous coal. The main constituents of creosote consist of (1) tar acids such as phenol, cresol and xylenol, etc.; and (2) tar bases such as pyridine, quinoline and acridine; and (3) neutral oils such as a mixture of naphthalene, anthracene, and other neutral hydrocarbons. Creosote has been used for many years to preserve wood from decay and biological attack. Inevitably, fresh creosote to be used in preserving wood will contain a small undesired amount of water, and used creosote, which has been used in a treating process to preserve wood, will contain the water originally present in the fresh creosote plus any water picked up in the treating process. The buildup of water in the creosote restricts the reuse of the creosote to treat wood; therefore, it is beneficial to remove some of the water from fresh creosote and from used creosote by dehydration so that the undesirable amount of water in the fresh creosote can be removed and so that the used creosote can again be used to treat wood.

Current dehydrators are genrally tanks with heating coils located inside the tanks. These dehydrators have several disadvantages, such as being energy intensive and creating large amounts of objectionable odors. Also, many times they operate for too long a period of time and end up driving off lighter fractions of the creosote. Also, the traditional location of the heating coils inside the tank cause the coils to coke up badly with a proportional decrease in heating ability and efficiency.

SUMMARY OF THE INVENTION

An object of the present invention is to provide a process and apparatus to dehydrate tars and/or hydrocarbon oils in a thermally efficient and environmentally acceptable manner while limiting problems of deposition on the heating mechanism of the derivatives of the tars and/or hydrocarbon oils from coking, coagulating, or congealing; and of fractionation of the tar and/or hydrocarbon oil.

An additional object of the present invention is to provide a process and apparatus to dehydrate creosote in a thermally efficient and environmentally acceptable manner while limiting problems caused by the deposition of coking derivatives of the creosote, the fractionation of lighter fractions of the creosote.

In accordance with the present invention, a process and apparatus are provided for dehydrating tars and/or hydrocarbon oils in a thermally efficient and environmentally acceptable manner. The process comprises: heating the tar and/or hydrocarbon oil to a temperature equivalent of the boiling point of water at a location external to any holding vessel for the tar and/or hydrocarbon, and spraying the heated tar and/or hydrocarbon oil into a holding vessel to enhance the separation of water from the tar and/or hydrocarbon oil, removing the water in the vapor state from the holding vessel to produce a dehydrated tar and/or hydrocarbon oil, and scrubbing the removed water to remove any noxious chemicals from the water, thereby making the water suitable for release to the environment. The apparatus comprises: a heating means having an inlet for communication with a source of tar and/or hydrocarbon oil, and having the capacity to heat the tar and/or hydrocarbon oil to the boiling point of water and being external to any holding vessel for the tar and/or hydrocarbon oil, and having a discharge end; and a spraying means communicating with the discharge end of the heating means to receive the heated tar and/or hydrocarbon oil and communicating with an enclosed member wherein the spraying means sprays the heated tar and/or hydrocarbon oil to enhance the separation of water from the tar and/or hydrocarbon oil; and said enclosed member connected with the spraying means to collect and to dispose of through a first outlet and dehydrated tar and/or hydrocarbon oil, and having a second outlet for removal of the water in the vapor state from the vicinity of the tar and/or hydrocarbon oil; and a scrubbing means adapted for communication with said second outlet means of the enclosed member, said scrubbing means removing noxious chemicals from the water vapor taken from the enclosed member, thereby making the water vapor or water suitable for release to the environment.

In accordance with a feature of the invention, the process of dehydration can include high velocity flow rates in conveying the tar and/or hydrocarbon oil to and through the heating step in order to create a scrubbing action on the heating surfaces of the heating means to reduce fouling and coking. Also, the heated tar and/or hydrocarbon oil can be atomized in spray nozzles as a type of spraying to create a larger surface area for the heated tar and/or hydrocarbon oil, thereby further promoting the change of water from the liquid state to the vapor state.

In accordance with still an additional feature of the invention, the apparatus used to dehydrate the tar and/or hydrocarbon oil can include one or several heating means in a series. Also, in the apparatus the spraying means can be an atomizing means to break more effectively the surface tension between the tar and/or hydrocarbon oil and the water and to promote the change of water from a liquid state to a vapor state.

In accordance with still another feature of the invention, the process and apparatus can include an enclosed member that is a holding vessel from which the tar and/or hydrocarbon oil is removed for heating in the heating means, while also being the enclosed member in which the heated tar and/or hydrocarbon oil is sprayed or atomized by the spraying means or atomizing means. In addition to the inlet for the spraying means and the two outlets for the water and dehydrated tar and/or hydrocarbon oil, this enclosed member would have an inlet means to receive tar and/or hydrocarbon oil from a source and another outlet means for wet tar and/or hydrocarbon oil to be removed to the heating means. This enclosed member can be operated automatically with an automatic dehydrator control to start and stop the dehydrating process and apparatus.

In the specification and appended claims the term "dehydration" refers to the removal of the water in a tar and/or hydrocarbon oil to any degree desired. Also, the term "tar and/or hydrocarbon oil" refers to first to tar which is a product of destructive distillation or carbonization of coal, i.e., a coal tar including coal tar distillates, and water-gas and oil-gas tars derived from petroleum distillates or residuals, when the latter is cracked or gasified; and second, hydrocarbon oils such as neutral liquids comprising mineral oils derived from petroleum, coal, shale, etc., and consisting of hydrocarbons, and essential oils which are volatile products, mainly hydrocarbons, with characteristic odors and which are derived from certain plants.

DETAILED DESCRIPTION OF THE INVENTION

Figure 1:
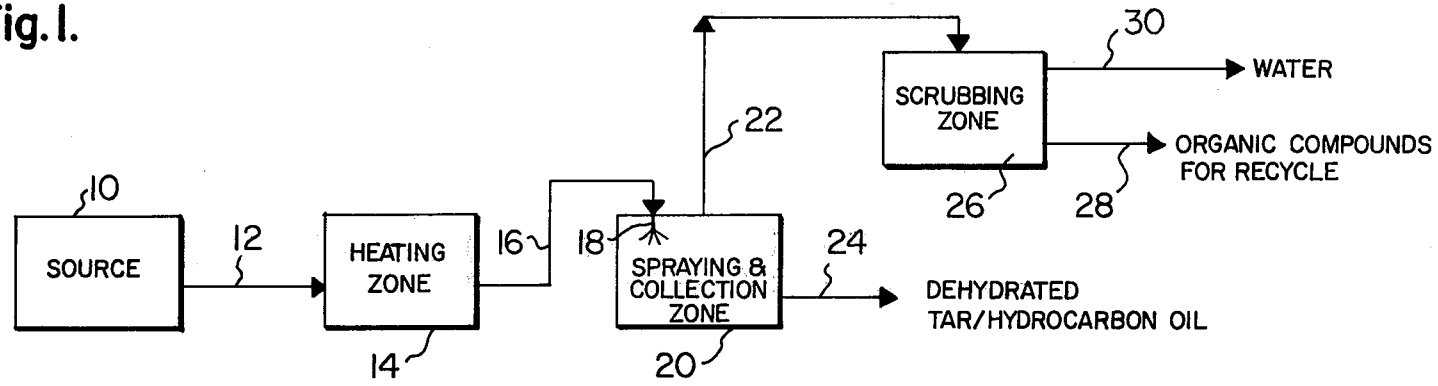
FIG. 1 is a schematic flow sheet of the process of the invention wherein the tar and/or hydrocarbon oil is introduced from a source into a heating step and then sprayed into a collecting vessel and the water vapor is removed from the collecting vessel and scrubbed before being released to the environment.

Referring to FIG. 1 of the drawings, numeral 10 designates a source of tar and/or hydrocarbon oil which contains an amount of water, making the tar and/or hydrocarbon oil undesirable for its particular use. The source can be an effluent containing tar and/or hydrocarbon oil from a chemical process or it can be tar and/or hydrocarbon oil used directly in a chemical process. Preferably the tar and/or hydrocarbon oil is the wood treating preservative, creosote, which has been used to treat wood, or is fresh creosote; both of which contain more water than is desired for treating wood. The amount of water contained in used creosote, that is creosote that has been used to treat wood, or fresh creosote, that is creosote that has not yet been used to treat wood, should not exceed, generally, about 3 percent by weight of the creosote. The tar and/or hydrocarbon oil that needs to be dehydrated is hereinafter referred to in the specification and in the claims as wet tar.

The wet tar is conveyed from the source via conduit 12 to a heating zone 14. This heating zone is external to any holding vessel or collection vessel for the wet tar. The heating zone may be any device known to those skilled in the art of tar and oil chemistry and chemical engineering that has the capacity to heat tar and/or hydrocarbon oils to a temperature above the boiling point of water. The heating zone should be an efficient, external, module-style heating zone. This type of heating zone makes it easy to remove, clean and flush the heating elements of the heating zone to maintain maximum heat transfer capabilities. Preferably, the heating zone is a shell-and-tube type heat exchanger having extremely high heat transfer rates while achieving low temperature gradients through the heat exchange surface by means of longitudinal thin fins on the tubes of the heat exchanger. It is also preferred to maintain relatively high velocity fluid flow rates through the shell side of the heat exchanger to create a high heat transfer coefficient and a scrubbing action of the heating surfaces and to eliminate fouling and coking of the longitudinal fins.

The heated wet tar is conveyed from the heating zone by conduit 16 to a spraying apparatus 18 located in the spraying and collection zone 20. The spraying nozzles can be any spraying nozzles known to those skilled in the art of tar and oil chemistry and chemical engineering to be useful in spraying tars and oils. Preferably the spraying device is an atomizer, and the type of atomizer used can be the singular or multiple pressure differential type. The spraying and, preferably, atomizing of the hot wet tar into the enclosed vessel 20 aids in breaking the surface tension bond between the tar and the water and creates a larger surface area for the heated wet tar, thereby promoting the change of water from a liquid state to a vapor state. As the hot tar is sprayed into the enclosed vessel 20, the water in the hot tar is converted into a vapor, while the tar remains a liquid. The liquid tar falls into the enclosed vessel 20 and is collected there. The water vapor remains at the upper level of the enclosed vessel and is removed from the enclosed vessel 20 by conduit 22. The liquid tar that is collected in zone 20 is dehydrated tar and is removed from zone 20 by conduit 24 and can be reconveyed to the chemical process, or, preferably, the dehydrated creosote can be reused in preserving wood.

Since the water vapor removed from spraying and collection zone 20 via conduit 22 may contain low boiling organic compounds contained in the hot wet tar flowing into spraying and collection zone 20, the water vapor in conduit 22 is scrubbed to remove these low boiling compounds before the water is exposed to the environment. In the preferred embodiment of the present invention, wherein the tar is creosote, the water vapor in conduit 22 may contain such organic compounds as naphtha, hydrazine, or other low boiling creosote vapors. These organic compounds may create an odor if the water vapor in conduit 22 is merely condensed and then exposed to the environment. Therefore, it is preferred to scrub the water vapor in any scrubbing system known to those skilled in the art to be useful in removing small amounts of organic compounds from water. Preferably, this scrubbing system is a low pressure drop unit not requiring a device to provide a motive force, and preferably works on an eductor principle similar to a steam vacuum jet. The water vapor containing the small amount of organic compounds is conveyed via conduit 22 to a scrubbing zone 26. In this zone the water vapor is condensed and the small amount of organic compounds is removed from the water. Although this removal may take place by any method known to those skilled in the art, it is preferred to remove the small amount of organic compounds from the water vapor simply by spraying the water with additional water provided from a source external to the process. The organic compounds removed from the water are collected and conveyed via conduit 28 for collection or addition to the dehydrated tar. The water is removed from the scrubbing zone 26 by conduit 30 and can be released to the environment as a vapor or liquid, if the water is condensed during scrubbing, without causing any deleterious effects.

The process as described in FIG. 1 can be operated as a batch-type process or as an automatic continuous process. It is preferred to operate the dehydration process as an automatic continuous process, as described in FIG. 2.

Figure 2:
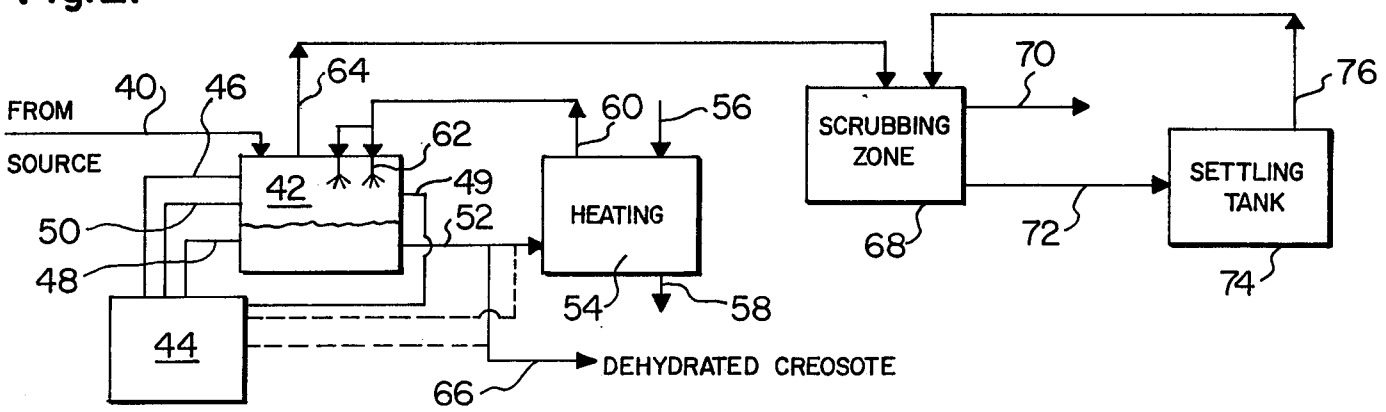
FIG. 2 is a schematic flow sheet of the process of the invention wherein the organic solution is collected in a holding tank, removed from the holding tank for heating, and sprayed into the collection tank for separation of water vapor from the tar and/or hydrocarbon oil and then the water vapor is removed from the holding collection tank and scrubbed.

FIG. 2 represents the preferred embodiment of the process of the present invention wherein the process is conducted in a completely automatic continuous manner for dehydrating creosote, although this preferred embodiment can also be used for other tars and/or hydrocarbon oils. The wet creosote that has been used in preservative treatments for wood, and/or fresh creosote having a higher than desired water content for treating wood in a preservative treatment enters the dehydration process via conduit 40. The wet creosote in conduit 40 enters the dehydrating tank 42. The dehydrating tank can be any holding vessel known to those skilled in the art to be useful in processes where tar and/or hydrocarbon oil must be stored. The dehydrating tank 42 contains several level and temperature sensing devices connected to automatic dehydrator controller 44. These sensing devices include a high fluid level sensor 46, a low fluid level sensing device 48, a temperature sensing device 49 and a final temperature sensing device 50. The wet creosote collected in the dehydrating tank 42 is removed from the tank via conduit 52 when the high fluid level sensing device indicates the wet creosote has reached a certain level in the dehydrating tank. The wet creosote is conveyed to a heating zone 54 that is preferably a series of shell-and-tube heat exchangers. This type of heat exchanger is an efficient, external, module style heating system designed to be highly maintainable so that individual heating elements can be easily removed, cleaned, and flushed to maintain maximum heat transfer capabilities, and thereby overcome any problems of coking, coagulation, or congealing of the creosote on the heating elements of the heat exchanger. Steam is conveyed to the heating zone by conduit 56 and the condensate from the heat exchanger leaves the heating zone via conduit 58. The wet creosote entering the heat exchanger 54 by conduit 52 is conducted through the heat exchanger at a relatively high velocity fluid flow rate to create a high heat transfer coefficient and a scrubbing action of the heating surfaces to eliminate fouling and coking of the longitudinal fins. The relatively high velocity fluid flow rates are preferably in the range of about 2 ft./sec. to 6 ft./sec. The velocity fluid flow rate through the heat exchanger is such that the wet creosote is heated to a temperature which is equivalent to, but preferably not in excess of, the temperature at which substantial amounts of low boiling compounds in the creosote are volatilized, or in excess of the boiling point of water. Preferably the temperature is in the range of about 100° C. to about 110° C. Although temperatures higher than 110° C. can be used, such use would be inefficient since it would cause more organic compounds to be removed in the scrubbing zone and could possibly overload the scrubbing zone. A temperature slightly lower than the boiling point of water can be used, but such use would not maximize the amount of water that could be removed from the creosote.

The heated wet creosote is removed from the heat exchangers by conduit 60 and is conveyed back to the dehydrating tank 42 through spraying devices 62. The spraying devices are preferably a series of atomizers which may be any atomizer known to those skilled in the art to be useful in atomizing tars and/or hydrocarbon oils. The atomizer sprays the hot creosote to form droplets, thereby breaking the surface tension bond between the creosote and water and also creating a large surface area for the heated creosote, both of which promote the change of water from the liquid state to the vapor state. The water vapor remains at the uppermost portion of the dehydrating tank 42 and is removed from the dehydrating tank by conduit 64. The dehydrated creosote which is still in a liquid state falls into the dehydrating tank 42 and is collected there.

The water vapor in conduit 64 may contain low boiling organic compounds from the creosote such as naphtha, hydrazine, or other creosote vapors that may create an odor. The water vapor is conveyed to a scrubbing zone 68 where the noxious organic compounds are removed from the water. Any process known to those skilled in the art for removing oil from an aqueous solution may be used, such as scrubbing with liquid water. The water which has been scrubbed to remove noxious chemical compounds is removed from the scrubbing zone by conduit 70 and may be exposed to the environment. Any organic compounds removed from the water are removed from the scrubbing zone via conduit 72 and are conveyed to a water organic compound separator which may be any separator known to those skilled in the art to be useful in separating organic compounds from water, for example, biological separators, chemical separators for chlorinating or treating with ozone or mechanical separators like decanters. It is preferred to use a settling tank 74. Any water recovered from the settling tank can be recycled to the scrubbing zone via conduit 76.

The dehydrating process is operated in such a manner that the dehydrating tank 42 is filled to a level with wet creosote and the high level sensing device senses this level and closes a valve in conduit 40 to prevent the further flow of wet creosote into the dehydrating tank 42. Then the wet creosote flows through conduit 52 and continues through the process to become dehydrated creosote that is collected in dehydrating tank 42. The wet creosote can contain 40 or 50 percent or more by weight of water. And through the dehydration process this wet creosote is dehydrated so that the dehydrated creosote contains an amount of water in the range of around 2 percent by weight, which is an acceptable amount of water in creosote for treating wood in a preservative treatment. When the temperature of dehydrated creosote reaches the high temperature of around 110° C. a temperature sensing device signals the automatic dehydrator control to close the valve in conduit 52 and to open the valve in conduit 66, allowing the dehydrated creosote to flow to storage or to be used in treating wood in a preservative treatment. When the level of dehydrated creosote in the dehydrating tank 42 falls to the level of the low fluid level sensing device, the valve in conduit 66 is closed and the valve in conduit 40 is open to allow the flow of wet creosote into the dehydrating tank. And again, when the level of wet creosote in the dehydrating tank reaches a high fluid level sensing device, the valve in conduit 40 is closed by the automatic dehydrator control and a valve in conduit 52 is open to allow the wet creosote to be dehydrated. The sensing devices and the automatic sensor control 44 can be any device known to those skilled in the art for sensing and controlling levels of liquid in containers.

The foregoing has described the general operation and the preferred operation of a process for dehydrating tar and/or hydrocarbon oil and, preferably, creosote in a more thermally efficient and environmentally acceptable manner.

Figure 3:
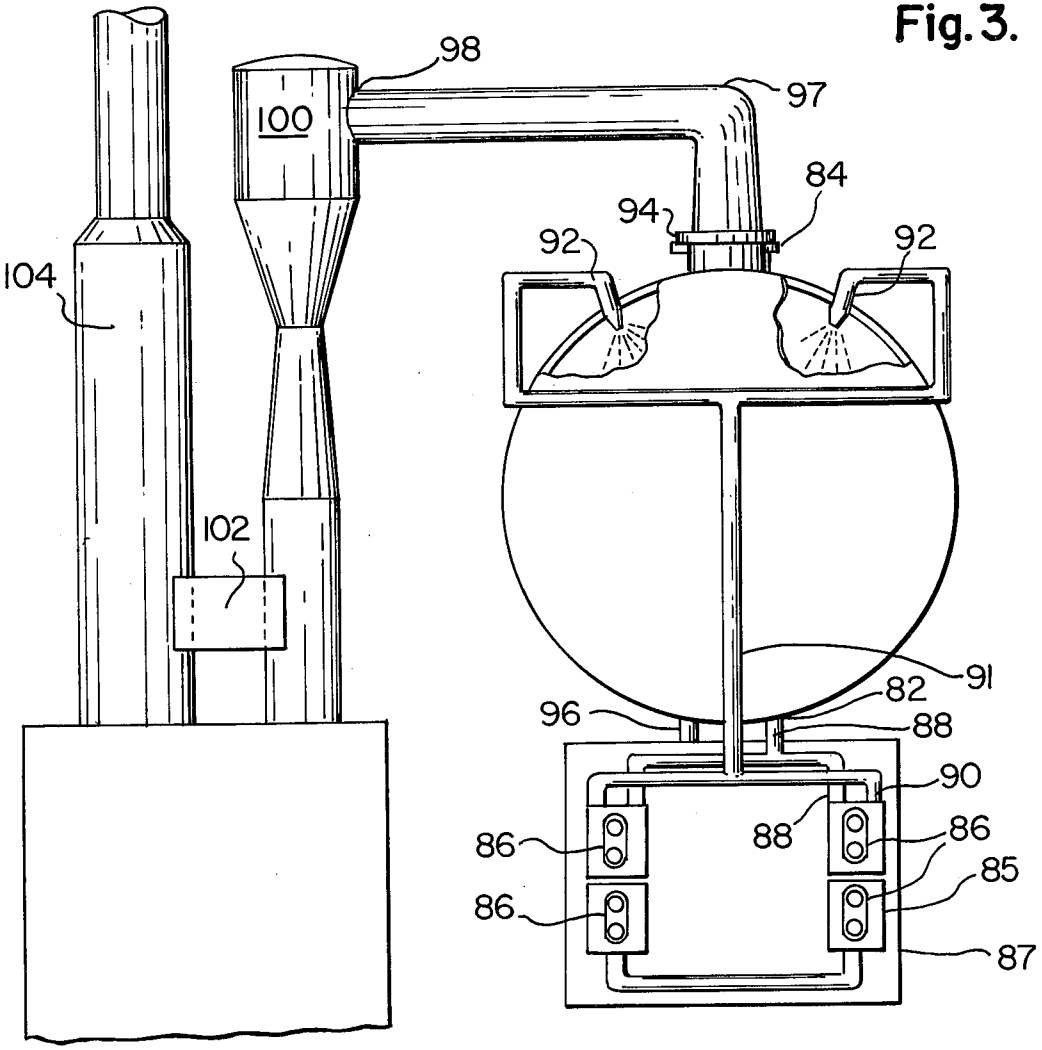
FIG. 3 is an end view of the apparatus of the invention comprising a heating means, spraying means, an enclosed member, and scrubbing means.

With reference to FIG. 3, an end view of the apparatus of the present invention is presented. An enclosed member 80 is shown having a first outlet 82 at the opposite end presented in FIG. 3 by which the enclosed member communicates with the heating means 86. The enclosed member also has a first inlet 84 at the opposite end from that shown in FIG. 3 by which the enclosed member receives wet tar and/or hydrocarbon oil from a source. It is preferred that the enclosed member be equipped with a high and low fluid level sensing device and a high temperature sensing device (not shown in FIG. 3).

From the first outlet 82 of the enclosed member, wet tar and/or hydrocarbon oil is transferred to heating means 86. The heating means is external to enclosed member 80 and has an inlet 88, at the opposite end of that shown in FIG. 3, to receive the wet tar and/or hydrocarbon oil from the enclosed member. The heating means 86 can be any heating means known to those skilled in the art to be capable of heating tar and/or hydrocarbon oil external to the enclosed member and to a temperature about equivalent to the boiling point of water. Preferably, the heating means is a series of two shell-and-tube heat exchangers with longitudinal fins. Reference numbers 85 and 87 in FIG. 3 indicate support structures for the shell-and-tube heat exchangers 86.

The hot wet tar and/or hydrocarbon oil is conveyed from the discharge end 90 of the heat exchanger 86 by conduit 91 to the spraying means 92 inside enclosed member 80. The hot tar and/or hydrocarbon oil is preferably conveyed by conduit 94 which is divided to run along both sides of enclosed member 80. This provides for the use of several spraying means along the sides of the enclosed member. Preferably, eight spraying means are used in the enclosed member and they are arranged four on each side of the enclosed member. Where the spraying means enters the enclosed member, the enclosed member has inlets to receive the spraying means. The spraying means may be any spraying means known to those skilled in the art to be useful in spraying tar and/or hydrocarbon oil. Preferably, the spraying is accomplished by an atomizer like that produced by Spraying Systems Inc., Wheaton, Illinois 60187. The spraying means enhances the separation of water from the hot tar and/or hydrocarbon oil. Water vapor accumulates in the upper portion of enclosed member 80 around the second outlet 94 of the enclosed member. The dehydrated tar and/or hydrocarbon oil remains a liquid and is collected in the enclosed member 80 and may be removed from the enclosed member by the third outlet 96.

The water vapor is conveyed from the second outlet of the enclosed member through conduit 97 to the inlet 98 of scrubbing means 100. The scrubbing means is preferably that known as an ejector-venturi scrubber, but may be any scrubbing means known to those skilled in the art to be useful in removing small quantities of organic compounds from water. The scrubbing means includes an outlet port 102 by which water is removed and released to the environment by stack 104.

Figure 4:
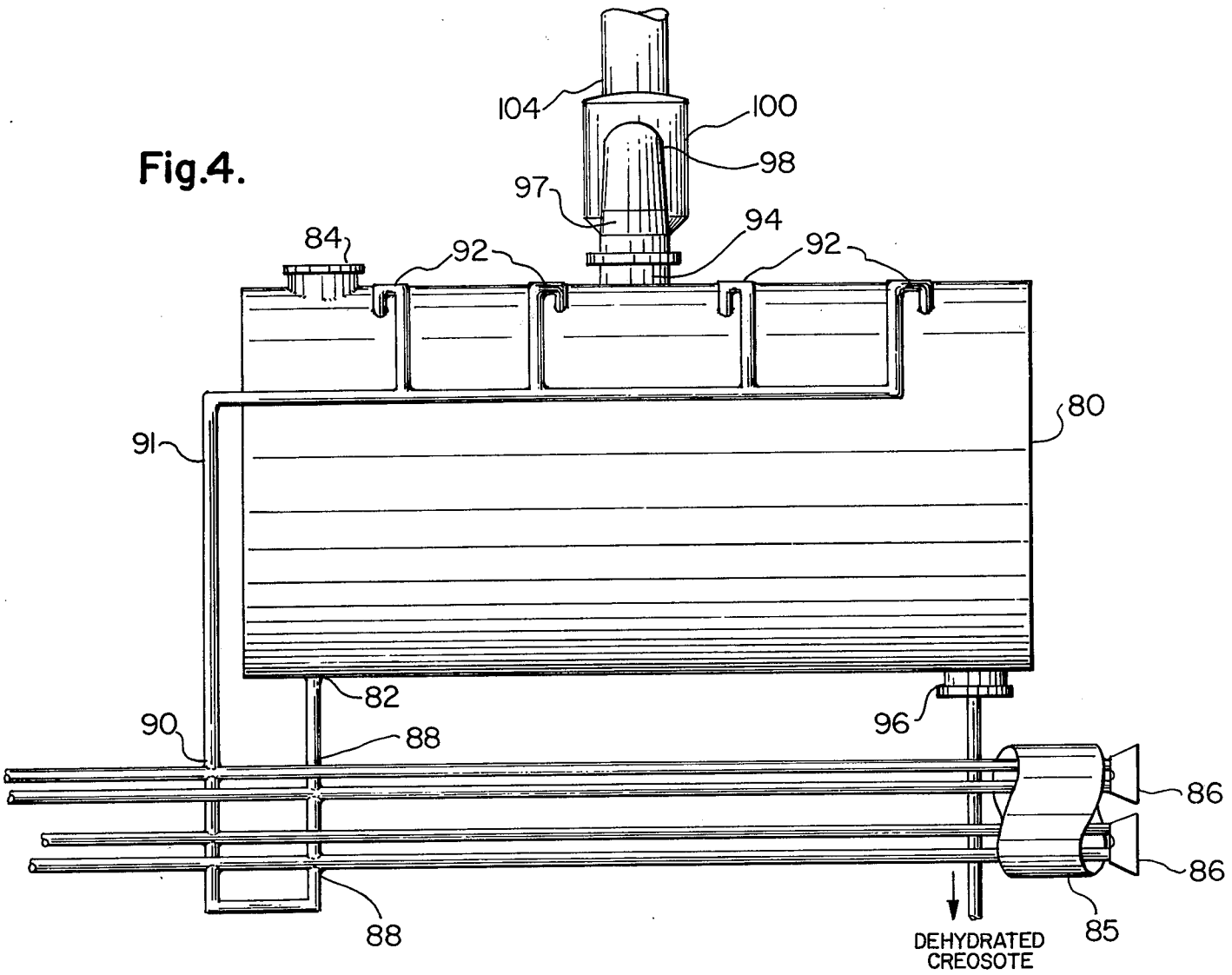
FIG. 4 is a side view of the apparatus of the invention comprising a heating means, spraying means, an enclosed member, removal means and scrubbing means.

Referring to FIG. 4, there is presented a side view of the apparatus of the present invention. The enclosed member 80 has first outlet port 82 by which it communicates with the inlet 88 of heating means 86 that is supported by support 85. Also, the enclosed member has a first inlet 84 for receiving a supply of wet tar and/or hydrocarbon oil and, preferably, creosote. The heated tar and/or hydrocarbon oil leaves the heat exchanger at discharge end 90 and is conveyed by conduit 91 to the spraying means 92 located in inlets in the enclosed member 80. Preferably there is a series of four spraying means on each side of the enclosed member and, preferably, the spraying means are atomizers.

The water vapor formed by the atomizing of the hot tar and/or hydrocarbon oil leaves the enclosed member 80 through outlet 94 and is conveyed by conduit 97 to the inlet port 98 of scrubbing means 100. As described above, the scrubbing means is preferably the apparatus manufactured and produced by Ametek Inc. Process Systems, Durham, North Carolina 27704. This scrubbing means enables any noxious organic compounds present in the water vapor to be removed from the water and also provides for the condensation of the water vapor. Any air present in the water vapor from the dehydrator is removed from the process by stack 102 and is exposed to the environment. The condensed water and scrubbing water from the scrubber 100 is sent to a separator before being released to the environment.

The foregoing has described the apparatus by which the process of the present invention is able to dehydrate tar and/or hydrocarbon oil in a more thermally efficient and environmentally acceptable manner.

I claim:

1. A process for dehydrating tar and/or hydrocarbon oil in a thermally efficient and environmentally acceptable manner comprising:

(a) heating the tar and/or hydrocarbon oil to a temperature above the temperature of the boiling point of water in a heating zone which is external to the storage container for said tar and/or hydrocarbon oil;

(b) spraying the heated tar and/or hydrocarbon oil into a vessel in order to break the surface tension bond between tar and/or hydrocarbon oil and water to vaporize the water in said tar and/or hydrocarbon oil and remove the water vapor from said vessel;

(c) scrubbing the water vapor removed from said vessel to remove organic compounds present in the water vapor;

(d) condensing said water vapor and separating the layer of noxious organic compounds from the water layer before releasing the water to the environment; and (e) withdrawing the dehydrated tar and/or hydrocarbon oil from the vessel in which the heated tar and/or hydrocarbon oil is sprayed.

2. A process according to claim 1 wherein high transfer rates are used in the heating of the tar and/or hydrocarbon oil.

3. A process according to claim 1 wherein a high velocity fluid flow rate is used in the heating of the tar and/or hydrocarbon oil.

4. A process according to claim 1 wherein the tar and/or hydrocarbon oil is heated to a temperature to a range of 100° C. to about 110° C.

5. A process according to claim 1 wherein the liquid level of tar and/or hydrocarbon oil present in said storage container and the liquid level of the collecting container for the dehydrated tar and/or hydrocarbon oil are sensed automatically to allow for continuous operation of the process.

6. A process according to claim 1 wherein the tar and/or hydrocarbon oil is creosote.

7. A process according to claim 1 wherein the scrubbing of the water vapor is accomplished in an ejector venturi type scrubber with liquid water.

* * * * *